US005702025A

United States Patent [19]

Di Gregorio

[11] Patent Number: 5,702,025

[45] Date of Patent: Dec. 30, 1997

[54] LEAK FREE LID WITH CLOSURE AND SPOUT

[76] Inventor: Vito Di Gregorio, 119 Arthur Ave., Staten Island, N.Y. 10305

[21] Appl. No.: 643,815

[22] Filed: May 6, 1996

[51] Int. Cl.[6] ..... B65D 47/28

[52] U.S. Cl. ..... 220/717; 222/559; 222/561; 222/529; 220/714; 220/784

[58] Field of Search ..... 220/254, 262, 220/345, 351, 784, 780, 786, 788, 703, 705, 709, 711, 713–717; 215/387, 389, 317, 321; 222/559, 561, 529, 531

[56] References Cited

U.S. PATENT DOCUMENTS

| | | | |
|---|---|---|---|
| 2,555,459 | 6/1951 | Seufer | 222/561 |
| 2,608,841 | 9/1952 | Rice | 220/717 X |
| 2,622,420 | 12/1952 | Rice | 222/559 |
| 3,302,644 | 2/1967 | Kennedy et al. | 215/387 X |
| 3,792,797 | 2/1974 | Mrusek et al. | 220/784 |
| 3,840,152 | 10/1974 | Hodge | 220/786 X |
| 3,892,327 | 7/1975 | Leitz | 215/321 X |
| 3,938,690 | 2/1976 | Butler | 618/75 |
| 4,428,498 | 1/1984 | Obey | 220/705 X |
| 4,832,238 | 5/1989 | Taylor | 222/529 |
| 5,083,672 | 1/1992 | Lewandowski | 222/561 X |
| 5,234,117 | 8/1993 | Garvin | 215/388 X |
| 5,289,945 | 3/1994 | Stradder | 222/561 X |
| 5,433,338 | 7/1995 | Proshan | 220/717 |

*Primary Examiner*—Allan N. Shoap
*Assistant Examiner*—Nathan Newhouse
*Attorney, Agent, or Firm*—J. Sanchelima

[57] ABSTRACT

A lid to be used to dose the opening of a cooperative container providing a user with a spout that is selectively closed and opened to permit a user to draw the liquid inside the container and, if accidentally dropped, to avoid spillage and/or leakage of its contents. A slidable door is activated by a user to selectively block the liquid from coming out through the spout. A locking mechanism to keep the lid firmly and removably secured to the container includes a several latching members that extend perpendicularly from the periphery of the lid and engage with a corresponding number of openings formed in a peripheral locking member positioned adjacent to the rim of the container's opening.

6 Claims, 4 Drawing Sheets

FIG. 1.
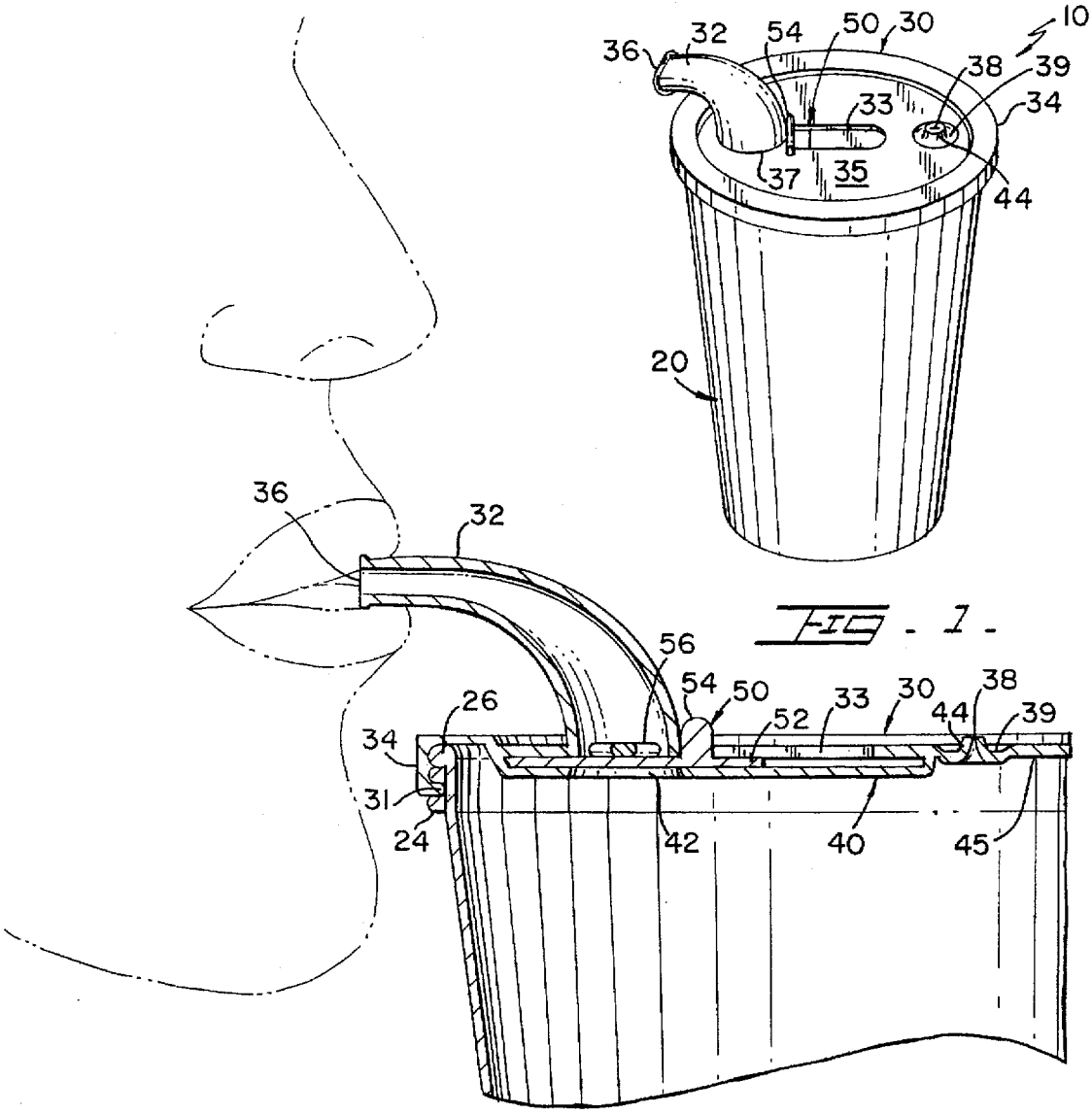
FIG. 3.
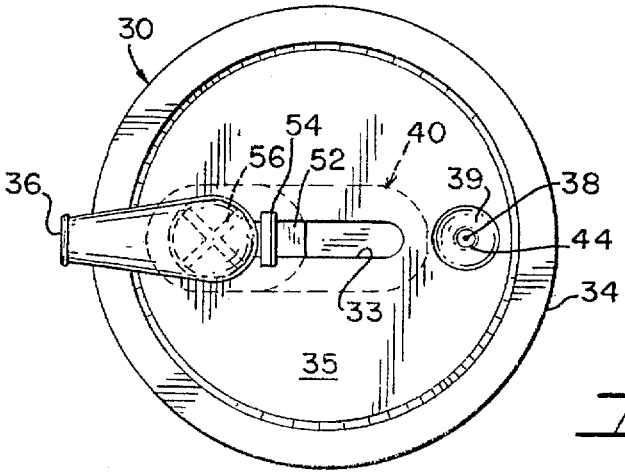
FIG. 2.

LEAK FREE LID WITH CLOSURE AND SPOUT

BACKGROUND OF THE INVENTION

1. Field of the Invention

The present invention relates to a leak free lid for containers, and more particularly, to the type that includes a spout with a closure member and a leak free engagement to the container.

2. Description of the Related Art

Applicant believes that the closest reference corresponds to U.S. Pat. No. 3,938,690 issued to Butler in 1976. However, it differs from the present invention because even though it includes a closure member slidably mounted on the cover, it nevertheless fails to disclose a spout member and a peripheral locking mechanism to ensure leak-free engagement of the cover to the container.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a leak free lid assembly for dosing containers that prevents spillage of the liquid contained in the latter.

It is another object of this invention to provide a leak free lid assembly that includes a spout conveniently and cooperatively mounted thereon to permit a user to drink the liquid contained therein.

It is still another object of the present invention to provide a vessel cover with a spout that includes a blocking member to prevent solid pieces, such as ice pieces, from flowing out through the spout.

It is another object of this invention to provide a closure member that allows a user to selectively open and close the flow through the spout mounted on the lid assembly.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 is an isometric view from the top of the present invention mounted to a container.

FIG. 2 is a top view of this invention.

FIG. 3 is a partial elevational cross sectional view of the preferred embodiment, subject of the present invention, taken along line 3—3.

DETAILED DESCRIPTION OF THE PREFERRED EMBODIMENT

Figure 2B:
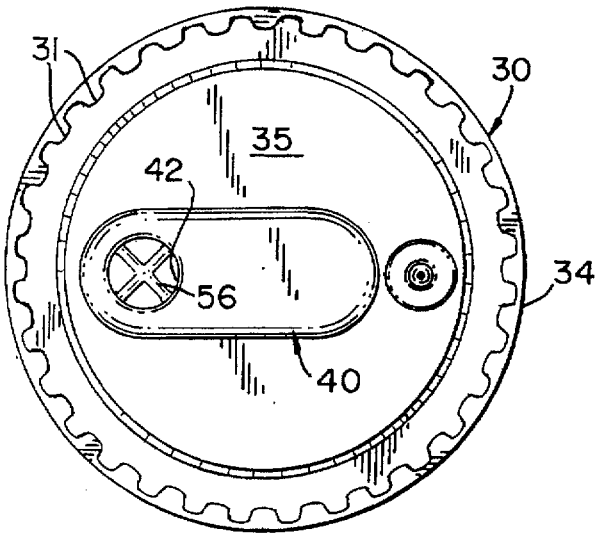
FIG. 2B is a bottom view of the lid assembly, shown in the previous figure.

Referring now to the drawings, where the present invention is generally referred to with numeral 10, it can be observed that it basically includes container 20 and lid assembly 30 with spout member 32 mounted thereon. Peripheral locking member 24, on the outer surface of container 20, below its rim 26, is designed for locking engagement with inwardly extending latching members 31 of peripheral member 34 mounted on the inner surface of the skirt of lid assembly 30. Peripheral locking member 24 resembles, in the preferred embodiment, a belt with openings 25 that cooperatively receive latching members 31, as best in FIGS. 2B; 3 and 4. The engagement is sufficiently strong to allow a user to invert the container, full of liquid, without any leakage. This is particularly useful for paper or plastic containers, such as cups, served in fast food restaurants with hot liquids, such as coffee, to customers, specially, in a drive through where the customer is typically occupied driving a vehicle. Thus, if container 20 and lid assembly 30 are dropped accidentally by a user, the hot coffee or any other liquid contained therein, does not escape. Also, the engagement of latching members 31 with peripheral locking member 24 is sufficiently strong to hold lid assembly 30 to container 20 when a user lifts and tilts the latter or pour the contents. Lid assembly 30, also is designed to thermically insulate the contents.

In the preferred embodiment, spout member 32 is, at end 37, rigidly mounted to surface 35 at a suitable distance from the outer edge for a user to conveniently apply his or her lips to mouthpiece end 36 of spout member 32. Also, lid assembly 30 has small venting or relief pin hole 38, preferably with a cross shape, on frustoconical extension 44 extending outwardly from recess 39. Venting or relief pin hole 38 allows air in as the liquid is displaced. The amount of liquid that goes through pin hole 38 is minimal, if any.

As shown in FIGS. 1 through 3, closure assembly 50 is mounted to underside 45 and within housing assembly 40. Closure assembly 50, in the preferred embodiment, includes sliding door member 52 and actuating member 54 rigidly mounted thereon. Member 52 is slidably mounted within housing assembly 40 that in turn is mounted to underside 45 of lid assembly 30. When a user desires to close the flow of liquid from inside container 20 through spout member 32, actuating member 54 is slidably pushed towards spout member 32. Member 54 protrudes through guiding slot 33 so that it can be readily accessible to a user. Member 52 closes opening 42 of housing assembly 40 and container 20 is sealed with the exception of venting pin hole 38. When a user desires to draw the liquid out, actuating member 54 is pushed away from spout member 32 and opening 42 is cleared for liquid to flow out. Blocking member 56, as shown in FIGS. 2, 2B and 3, is designed to block solids, such as ice and pieces of fruit, from coming out through spout member 32. Blocking member 56, in the preferred embodiment, has an "X" shaped and is positioned within spout member 32.

Figure 5:
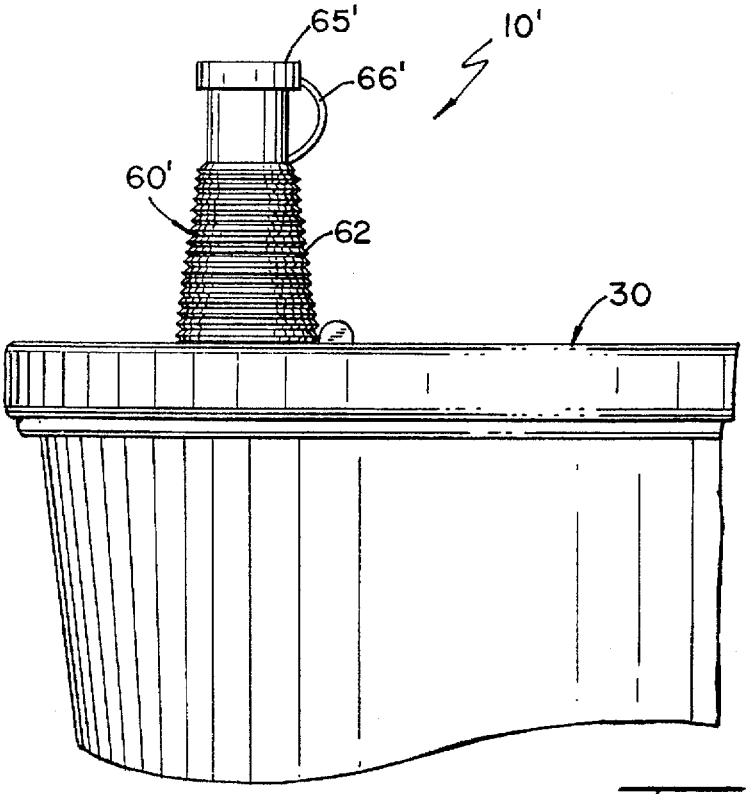
FIG. 5 represents a partial elevational view of an alternate embodiment for the spout assembly.
Figure 6:
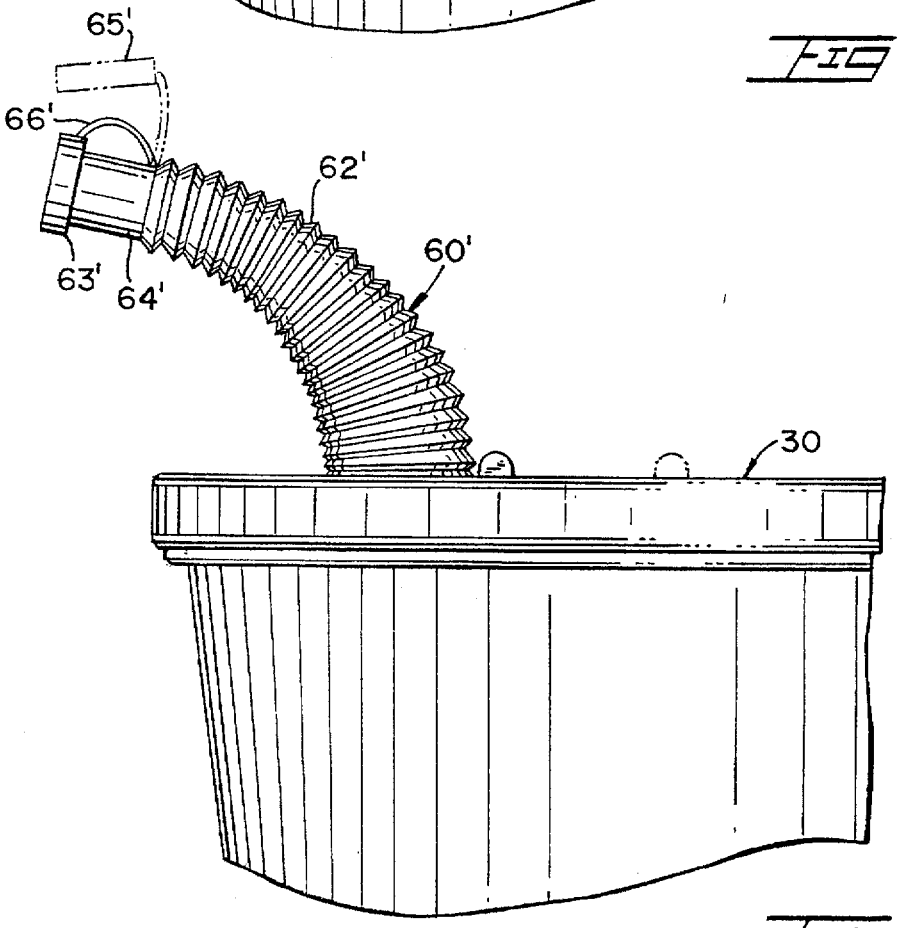
FIG. 6 represents a partial elevational view of the alternate embodiment for the present invention wherein a flexible spout is used, having a removable cap.

In FIGS. 5 and 6 an alternate embodiment 10' for the spout assembly is shown mounted to lid assembly 30. Spout assembly 60' corresponds to the accordion type having tubular member 62' with a rounded cross-section and ending with flat mouthpiece 64'. Spout assembly 60' includes, at distal end 63' of mouthpiece 64' cap member 65' that is mounted thereto by belt 66'.

Figure 8:
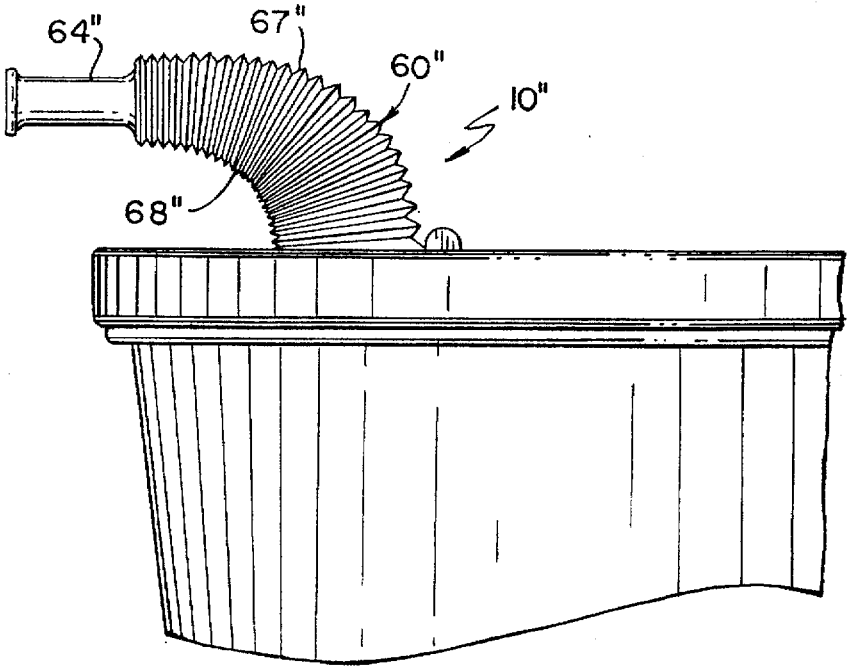
FIG. 8 is a partial elevational side view of the present invention having the spout previously shown in FIG. 7.
Figure 4:
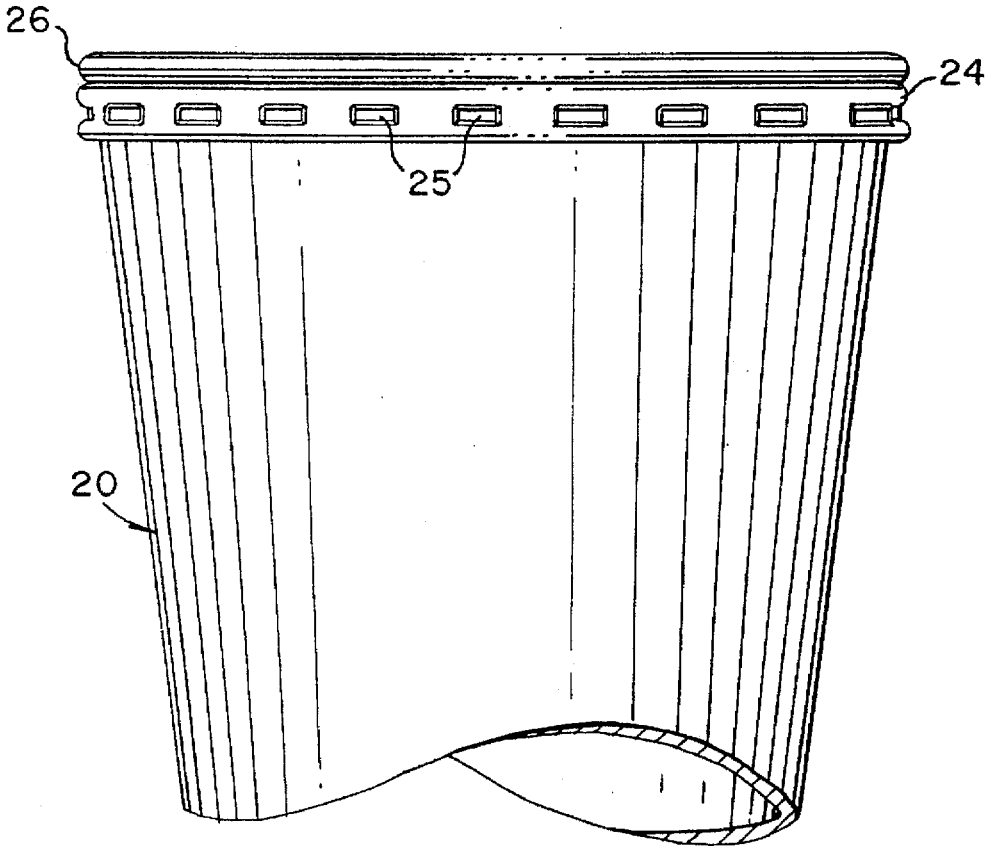
FIG. 4 is a partial elevational view of a container with a locking belt mounted thereon.
Figure 7:
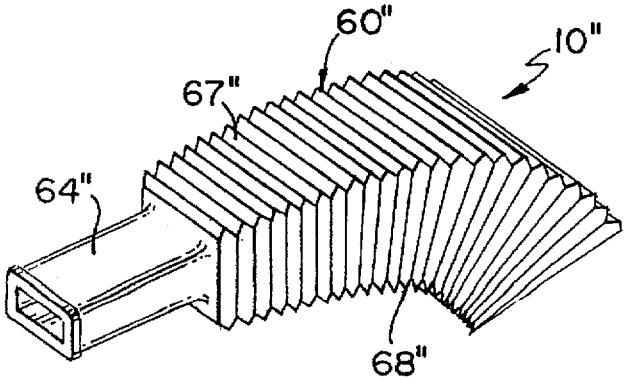
FIG. 7 is a partial isometric view of another alternate embodiment for the spout assembly.

In FIGS. 7 and 8 alternate embodiment 10" for the spout assembly is shown. Spout member 60" corresponds to the accordion type having a rectangular cross-section and ends with flat mouthpiece 64". Spout member 62" has side 67" longer than side 68" to ensure that it extends outwardly thereby making for a user to draw the liquid.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A lid for containers, having a peripheral rim and an underside, to be used to cover the opening defined by said rim of a container for liquids, comprising:

A) a spout member mounted on said lid substantially adjacent to said peripheral rim;

B) closure means for selectively blocking the flow of said liquid through said spout member wherein said closure means includes housing means mounted to the underside of said lid and further including a door member slidably mounted to said housing means;

C) means for locking said lid to said container to cause said container and lid engagement to be leak free wherein said means for locking said lid to said container includes a peripheral locking member located substantially adjacent to and below said rim and said peripheral locking member includes a plurality of openings, and said means for locking said lid to said container further including a corresponding plurality of latching means extending radially inwardly from said peripheral rim of said lid for removably and cooperatively engaging to said openings.

2. The lid set forth in claim 1 wherein said lid includes at least one small relief pin hole that permits the air to penetrate inside said container as the liquid flows out.

3. The lid set forth in claim 2 wherein said peripheral locking member is a belt.

4. The lid set forth in claim 3 wherein said spout includes a blocking member disposed therein to prevent solids mixed with a liquid inside the container from coming out through said spout member.

5. The lid set forth in claim 4 wherein said spout member includes a flexible accordion shaped tubular member.

6. The lid set forth in claim 5 wherein said accordion shaped to tubular member has a rectangular cross-section.

* * * * *